US006685332B1

(12) United States Patent
Clark

(10) Patent No.: US 6,685,332 B1
(45) Date of Patent: Feb. 3, 2004

(54) STAIR STRINGER LIGHT SET

(76) Inventor: Robert E. Clark, 28230 W. 89th St., De Soto, KS (US) 66018

( * ) Notice: Subject to any disclaimer, the term of this patent is extended or adjusted under 35 U.S.C. 154(b) by 0 days.

(21) Appl. No.: 10/230,911

(22) Filed: Aug. 29, 2002

(51) Int. Cl.[7] ..... F21S 1/02; F21S 4/00; F21S 8/00; F21V 21/14; F21V 17/00

(52) U.S. Cl. ..... 362/146; 362/145; 362/152; 362/250; 362/290; 362/366

(58) Field of Search ..... 362/146, 250, 362/290, 366

(56) References Cited

U.S. PATENT DOCUMENTS

| | | | | | |
|---|---|---|---|---|---|
| 2,756,323 | A | | 7/1956 | Tusly | 240/2 |
| 3,753,217 | A | * | 8/1973 | Willfurth | 362/146 |
| 4,394,714 | A | | 7/1983 | Rote | 362/146 |
| 4,425,601 | A | | 1/1984 | Donahue | 362/146 |
| 4,862,334 | A | * | 8/1989 | Ivey et al. | 362/149 |
| 5,222,799 | A | | 6/1993 | Sears et al. | 362/146 |
| 5,749,643 | A | * | 5/1998 | Porter et al. | 362/146 |
| 5,918,962 | A | | 7/1999 | Nagano | 362/146 |
| RE37,113 | E | * | 3/2001 | Shimada | 362/146 |

* cited by examiner

*Primary Examiner*—Sandra O'Shea
*Assistant Examiner*—James W Cranson, Jr.
(74) *Attorney, Agent, or Firm*—Kenneth W. Iles

(57) ABSTRACT

A light rope runs along the stringer of a stairway and is concealed by in-fill panels fitted into a groove on a frame rail running along the wall or stringer adjacent to the stairway. A light grille having a square frame and a patterned grille insert is seated along each tread adjacent to the next higher riser and is connected to the frame rail by a pair of adjustment arms. Translucent panels are mounted on the rear of the light grilles, allowing light to shine through them. Electrical circuitry turns the lights on when a user approaches the stairs and automatically turns the lights off after a predetermined time after the user has departed the area of the stairs.

20 Claims, 7 Drawing Sheets

STAIR STRINGER LIGHT SET

CROSS-REFERENCE TO RELATED APPLICATIONS

Not Applicable.

CROSS REFERENCE TO DISCLOSURE DOCUMENT

This application includes subject matter disclosed in Disclosure Document Number 510411 filed on Apr. 24, 2002.

STATEMENT REGARDING FEDERALLY SPONSORED RESEARCH OR DEVELOPMENT

Not applicable.

BACKGROUND OF THE INVENTION

1. Field of the Invention.

The present invention is related to an apparatus for lighting a stairway. More particularly, the present invention includes a rope light running along a stairway adjacent to a wall and concealed by in-fill panels and reflective light grilles, which allow light to shine through them and off of their reflective surfaces.

2. Description of the Related Art Including Information Disclosed Under 37 C.F.R. 1.97 and 1.98.

Stairways are notably dangerous and many accidents occur on them. Lighting stairways helps make them safer and, in addition, may make them more attractive, particularly when the lighting system provides aesthetic appeal.

Many different solutions to the problem of lighting stairways have been developed. Perhaps the most common is to suspend one or more electrical lights from the ceiling over or adjacent to the stairway. This solution lacks aesthetic appeal and does not provide as strong an indexing reference to the important location of the stair treads and height of the stair risers as lighting systems provide illumination near to or on each stair. Lighting solutions that provide light on each stair or adjacent to it have been the subject of several patents. Some of these include the following patent references. Each of these systems has certain shortcomings that are overcome by the present invention.

U.S. Pat. No. 5,918,962, issued to Nagano on Jul. 6, 1999, discloses a "Dual Step Light and Aisle Indicator Apparatus" comprising an extruded runner that lies along the side of the stairway to carry wiring and extruded caps that lie along the front edge of each stair and that hold lights that shine through translucent covers on the front of the risers. The system utilizes a light string. An electrical transformer and diode reduces line voltage about one-half. This solution requires a bump on the nose of each stair, increasing the risk of tripping on the stairs and presents an industrial, unfinished appearance.

U.S. Pat. No. 5,749,643, issued to Porter et al. on May 12, 1998, discloses a "Step Light with Diffuser" comprising a louver overhanging the housing to project line downwardly at an angle to illuminate the stair tread below it. The housing is mounted on the bottom surface of a stair tread in a portion of the tread that projects outwardly from the stair riser, requiring a very deep nose on each stair, which is an unusual construction. This system cannot be adapted for use with most stairs.

U.S. Pat. No. 5,222,799, issued to Sears et al. on Jun. 29, 1993, discloses "Stair Lights" comprising a lighting strip that operates on a low voltage alternating current supply and adapted to be installed under the juncture of a stair riser and stair tread. The lighting strip runs through an extruded C-shaped member that is fastened to the stair along the bottom surface of a stair tread at the juncture of the riser and stair tread. Sears et al. '799 discloses the possible use of 110 volt AC or 12–24 volts of AC or DC power sources (Column 1, lines 17–20). This reference also discloses the use of incandescent lights (Column 1, lines 26–27) and of light emitting diodes and related power supply (Column 2, line 18 et seq). A diffuser 23 runs along the length of the member that is fastened to the stairs. The diffuser 23 is preferably made of a transparent acrylic plastic (column 2, lines 65–66). Sears et al. '799 requires a stair nose that projects far beyond its supporting riser and also presents an industrial-type unfinished appearance. It cannot be adapted to work with the conventional stair design in which the nose of each stair is even with the leading edge of the supporting riser.

U.S. Pat. No. 4,425,601, issued to Donahue on Jan. 10, 1984, discloses a "Stairway Lighting System" comprising a transformer to produce reduced voltage AC electrical power to the lights and low voltage DC electrical power to various pressure switches and relays. The switches are pressure sensitive and are placed on the stair treads to turn the lights on when the stairs are stepped on. A light is placed behind a lens fastened to the front of the riser associated with each stair. All the lights come on automatically when a user begins walking on one or more stair treads and stay on until the person leaves the stairway. Then the lights are automatically turned off by the relay and they remain off until the next user steps on the stairs. This system requires considerable work to an existing stairway, namely cutting holes in the lower portion of the center of each riser in order to seat the lenses and it requires access to the back or underside of the stairway in order to install the wiring and other parts, perform maintenance, including changing lights and so forth. Many staircases are not readily accessible from the underside, particularly in residences, where staircases tend to be built on top of one another. Thus, this system has only limited, custom and expensive application.

U.S. Pat. No. 4,394,714, issued to Rote on Jul. 19, 1983, discloses a "Step Lighting System" comprising a plurality of fiber optic cables that are threaded through the back of each stair at the front edge of the tread and are illuminated by a light in a housing that directs light into the ends of the fiber optic cables, which are seated in the housing. This system allows a single centrally located light source to illuminate a number of stairs. This system is most suited for custom staircases that are built with this system in mind. It requires a space between the nose of a stair and the supporting riser; access from the underside of the staircase for installation and maintenance and the installation of curved extruded members to cover the gaps between the stair tread and the supporting riser, presenting an industrial-type, unfinished appearance and produces a direct glare.

U.S. Pat. No. 3,753,217, issued to Willfurth on Aug. 14, 1973, discloses a "Single Recessed Base Light" comprising a light seated in a recess in the wall adjacent to a stair tread (See especially FIG. 4). The housing is made from sheet metal. Low voltage high intensity light bulbs 68 are disclosed (Column 3, lines 45–46). "[C]onductors connect the socket 40 to a source of electric supply" (Column 2, lines 60–61). This system requires cutting holes in the wall and some type of wiring system that appears to require access to the space behind the wall, which is not usually available. This system requires substantial modification of the existing wall, creating damage that will not be easily repaired. It also requires access to a relatively deep cavity in the wall, which may not be available. It further provides an exposed light bulb, producing direct glare.

U.S. Pat. No. 2,756,323, issued to Tusly on Jul. 24, 1956, discloses an "Illuminated Stairway" comprising a light under the stairs, such as a long flourescent light tube that shines through openings where a riser meets a tread. The light from the bulb is projected through the opening between the top of each riser and each stair tread. This system requires a pronounced space between the top of each riser and each stair tread and access to the underside of the stairway. The opening between the riser and tread increases the risk of tripping. It also would permit small items to fall into the space under the stairway. The required access to the underside of the stairway is not usually available and neither is a stairway with the required gap between the stair tread and supporting riser.

Therefore a need exists for a stair stringer light set that does not require access to the underside of the stairway; that does not require cutting holes in the walls; that does not require a gap between the stair tread and the supporting stair riser; that can be installed on any type of stairway having an adjacent wall, including, for example, stairways with stairs that have projecting noses, stairways with a riser that meets the leading edge of the supported tread, and stairs carpeted with plush carpeting; that can be installed on existing stairways; that requires minimal disturbance of the existing stairway and adjacent wall.

BRIEF SUMMARY OF THE INVENTION

Accordingly, it is a primary object of the present invention to provide a stair stringer light set that does not require access to the underside of the stairway.

Accordingly, it is another object of the present invention to provide a stair stringer light set that does not require cutting holes in the walls.

Accordingly, it is another object of the present invention to provide a stair stringer light set that does not require a gap between the stair tread and the supporting stair riser.

Accordingly, it is another object of the present invention to provide a stair stringer light set that can be installed on any type of stairway having an adjacent wall, including, to for example, stairways with stairs that have projecting noses, stairways with a riser that meets the leading edge of the supported tread, and stairs carpeted with plush carpeting.

Accordingly, it is another object of the present invention to provide a stair stringer light set that can be installed on existing stairways.

Accordingly, it is another object of the present invention to provide a stair stringer light set that requires minimal disturbance of the existing stairway and adjacent wall.

These and other objects of the present invention are achieved in the preferred embodiment by providing a rope light (spaced low voltage parallel wired lights encased in a transparent plastic tube or rod) fastened to a wall adjacent to the stairway roughly parallel to the line along the noses of the stair treads from the top of the stairway to the bottom of the stairway; providing a light grille roughly at the juncture of each stair tread and the next ascending stair riser. A frame rail runs up the stairway along the line described above and provides a groove or channel for receiving and adjusting a pair of adjustable arms that keep each grille in place. The adjustable arm hardware extends to the wall that the light set is fixed to, creating contact points that stabilize the light grilles against lateral impact by creating a truss configuration. In-fill panels cover the area between the light grilles and the frame rail, providing a clean, attractive and finished appearance suitable for use in the most elegant surroundings.

A variety of grille patterns is available. A translucent or otherwise light-transmitting panel may fastened to the back of each light grille, allowing the light from the rope light to shine through, thereby illuminating each stair tread with a soft, pleasant light, both directly from the light source and from light reflected from the grilles' interiors, thereby improving visibility on the stairs. Alternatively, the light grilles may be open lattices. The translucent panels may also be light filters that provide a desired color of light. A transparent panel maximizes the direct and reflected light, while less transparent panels can be used to change the color of the light and the intensity of the light is diminished.

Preferably, the stair stringer light set is a low voltage incandescent system utilizing a transformer and associated circuitry that reduces and rectifies conventional 120 v AC electrical power to about 12 v DC. A simple switch may turn the lights on and off. Preferably, however, motion detectors at the top and bottom of the stairway cooperate with a delay timer to turn the lights on when a person approaches the stairway, either from the top or bottom of the stairway, and to turn the lights off some predetermined time after the person leaves the stairway, perhaps three to five minutes.

As used herein, "stairway" and "staircase" are used interchangeably and mean a "set of steps or stairs and its surrounding walls or other structure." Each stair includes a usually vertical riser to support the stair above it and a tread to step onto, typically horizontal. "As used herein, "stringer" means a side of a staircase, whether or not it supports the treads and risers.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE INVENTION

Figure 1:
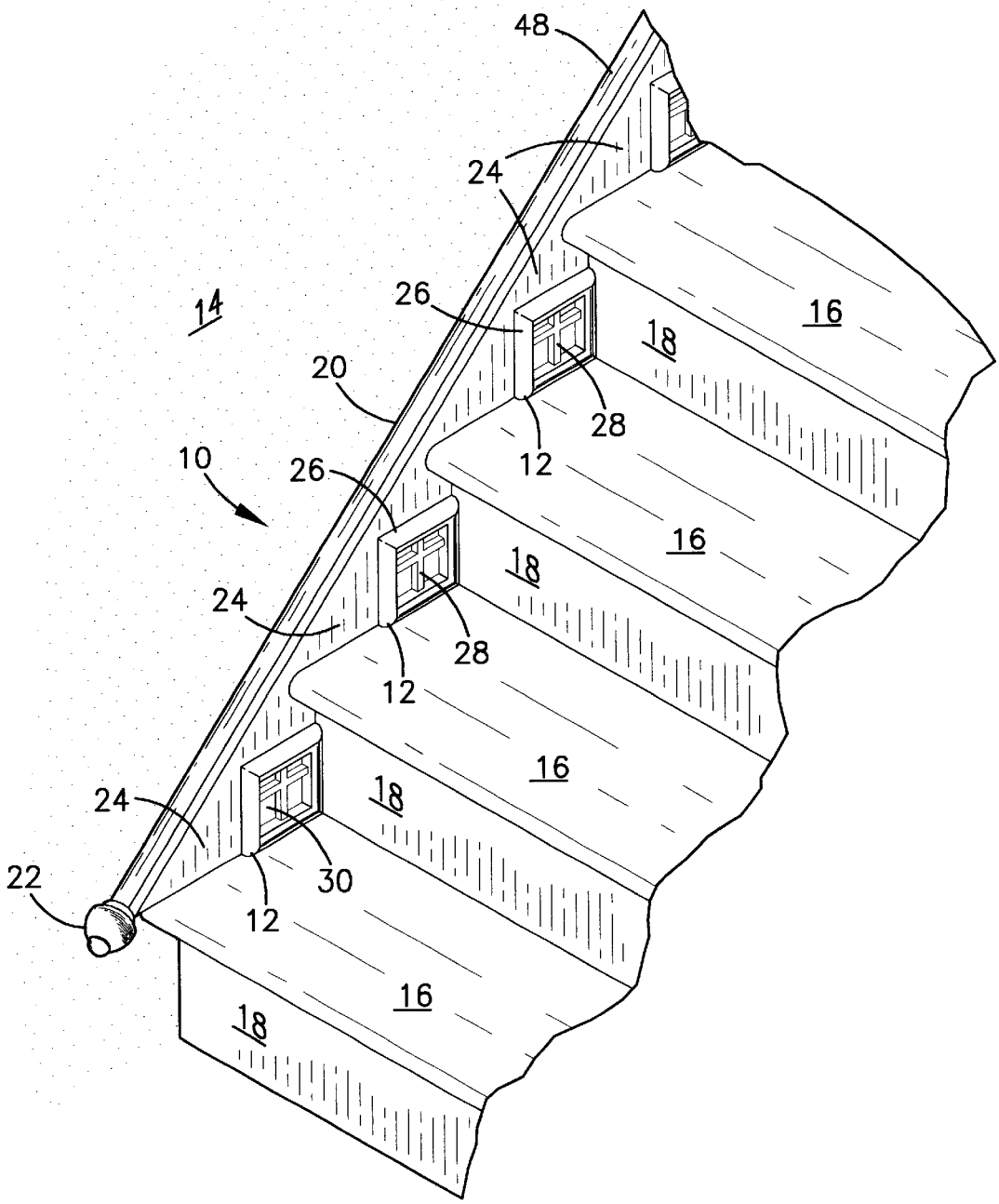
FIG. 1 is a right-hand perspective view of a staircase having an installed light stringer set according to the present invention.

Referring to FIG. 1, there is shown a perspective view of the staircase light stringer set 10 installed on a staircase 12. The light stringer set 10 includes a light grille 12 set against a wall 14 adjacent to each stair tread 16 and preferably placed against the riser 18 of each stair. A frame rail 20 runs up the stairs parallel to a line connecting the noses of each of the stair treads from the top of the stairs in the stairway to the bottom of the stairs in the stairway, where the stair nose is the portion of the tread that projects further toward or over the riser of the next descending stair tread. The frame rail 20 is preferably fastened to the wall 14 by screws, allowing light stringer set 10 to be removed from the wall 14 for servicing the lights. The screw heads are countersunk and painted to match the finish of the frame rail 20. The upper and lower ends of the frame rail 20 are finished with an finial 22. The frame rail 20 covers the upper edge of the in-fill panel 24 along the entire length of the angled upper edge, which fills in the area between the light grilles 12 and the stair treads 16 and stair risers 18, to provide a finished appearance and to hide the electrical wires, rope light and so forth. The lower edges of the in-fill panels 24 fit into a lower groove 27 in the frame 29 of the light grille 12. The upper edge of the in-fill panels 24 fit into an upper groove 33 formed in the frame rail 20 (See FIG. 10). The in-fill panels 24 are either manufactured to fit a particular size staircase or are custom made or trimmed to fit a particular staircase after the other elements of the light stringer set 10 has been installed by conforming it to a particular stairway.

Still referring to FIG. 1, the frame rail 20 also holds the framework arms that hold the light grilles 12 in place (discussed below). Light is reflected from the interior of the light grilles 12, as well as projected through the light grilles 12, illuminating objects in space and lighting the stairs to improve safety and to present a pleasing effect.

Figure 2:
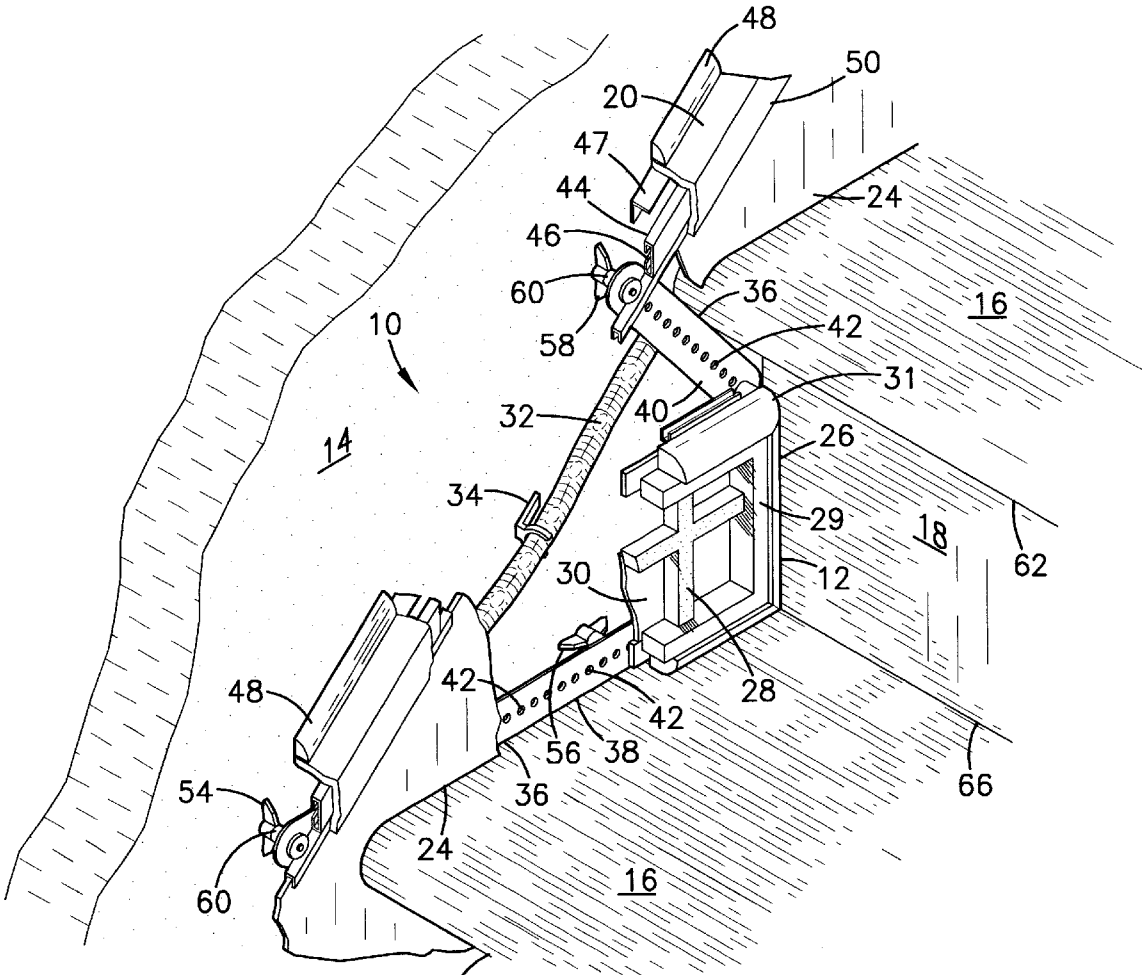
FIG. 2 is an enlarged fragmentary right-hand perspective view of a portion of the light stringer set of FIG. 1 during installation.

Referring to FIG. 2, each light grille 12 consists of a perimeter frame 26, which is preferably formed into a square, with a relatively thick ornamental pattern formed inside the light grille 12, such as the cross 28. Fastened to the back side of the perimeter frame 24 by adhesive, staples, brads or other suitable fasteners may be a light-transmitted panel 30, that keeps dust and dirt out of the stringer light set 10, while allowing light to shine through the translucent or light-transmitting panel 30 and the light grille 12. The perimeter frames 26 could be in any desired geometrical shape, including, for example, a circle, an oval, pentagon, hexagon, octagon, rectangle, trapezoid or the like. The actual cross section of the framing material is preferably that of a quarter-round molding member as show, but can be any desired shape. The perimeter frame may be formed from rectilinear cross section material, as in the frame 29, and is then trimmed with the quarter-round molding 31.

Still referring to FIG. 2, it has been found that when the light grilles are simply a perforated flat screen or openings in the light grilles 12, the light is principally visible only when the user looks directly at or into the light grilles 12. A light grille 12 having a substantial thickness in the range of about (5.7–6.5 cm) 1.5–2.4 inches) allows light to be reflected from the sides of the light grille 12, its frame 29, and pattern of the bars, or grille members, 102 to provide illumination when viewed at an acute angle. This effect is enhanced when the surfaces of the light grilles 12 are highly reflective or absorb and re-transmit light. The ornamental grille patterns are slightly thinner than the quater round molding 31, leaving a surrounding gap 25 between the quarter round molding trim 31 and the translucent panel 30, which is held in place by the tabs 37, which are preferably quarter circle planar members lodged into each corner of the frames 29 (See FIGS. 7–9).

Still referring to FIG. 2, the translucent panel 30 may be provided in any desired color or degree of translucency or indeed, may be transparent for an industrial look that exposes the light source behind the light grille 12. Each light grille 12 in a particular light stringer 10 installation are preferably of the same design, although different light grille 12 designs could be mixed in one set. Each light grille 12 is preferably seated against the back of each stair tread 16 (against the next ascending riser 18) because this placement reduces the work need to produce and install the in-fill panels 14, which would otherwise require at least two in-fill panels 24 for each light grille 12. Nonetheless, the light grilles 12 may be installed anywhere along the risers 18 that may be desired. The light grilles 12 may be integrally formed with the associated frame 29, but are preferably inserts that are pressed into the frames 29 by the user and held in place by the tabs 37, discussed below (See FIGS. 7–9) or, by hook and loop fasteners or the like. This allows the user to change the design of the light grilles 12 easily without removing the frames 29, thereby changing the appearance of the light stringer set 10.

Still referring to FIG. 2, a rope light 32 runs along the general direction of the frame rail 20 and is fastened to the wall 14 by the fittings 34, which are fastened to the wall 14 by suitable fasteners which are preferably screws. The rope light 32 is a length of transparent plastic tubing having wiring and a plurality of small lights spaced apart throughout the length of the tubing. Since the light is more or less uniformly distributed along the length of the rope light 32, it is not necessary that it be placed directly behind the light grilles 12 in order for the light to reflect from and to project through the light grilles 12, but the rope light 32 can be routed so as to pass directly behind the light grilles 12 if desired. Alternatively, parallel wired individual light bulbs connected by wires may be placed directly behind each light grille 12. Each light grille 12 is held in place by a pair of adjustable framework arms, including a horizontal arm 38 and an upper arm 40. Each horizontal arm 38 and upper arm 40 includes a plurality of spaced apertures 42 aligned along a line. A slot could also be formed in the arms 38, 40, but it has been found that a series of apertures preserve greater strength in the arms, which is desirable.

Figure 3:
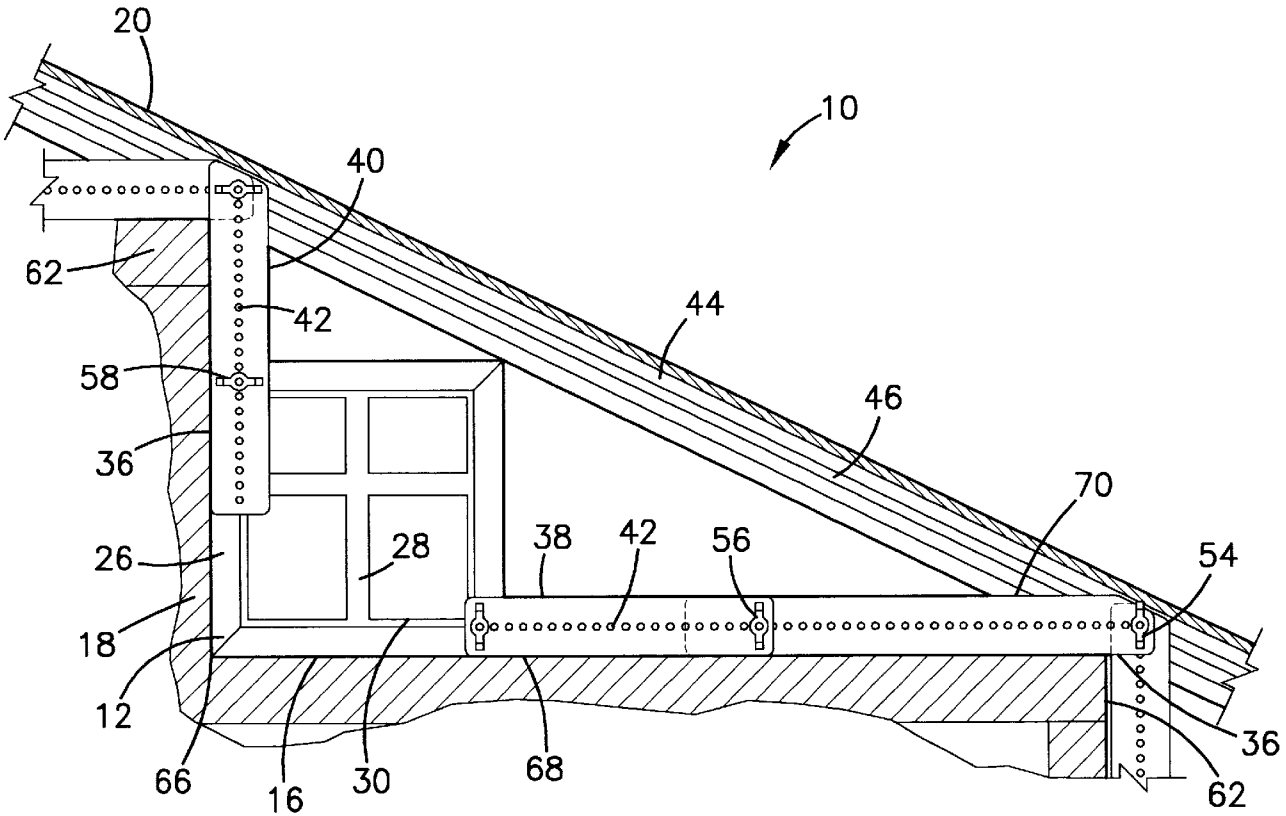
FIG. 3 is a fragmentary side elevation of a portion of the light stringer set of FIG. 1 shown in place on a cross sectional portion of a staircase and illustrating the use of framework arms connected to a frame rail to keep the light grille in place for use with a straight riser staircase.
Figure 5:
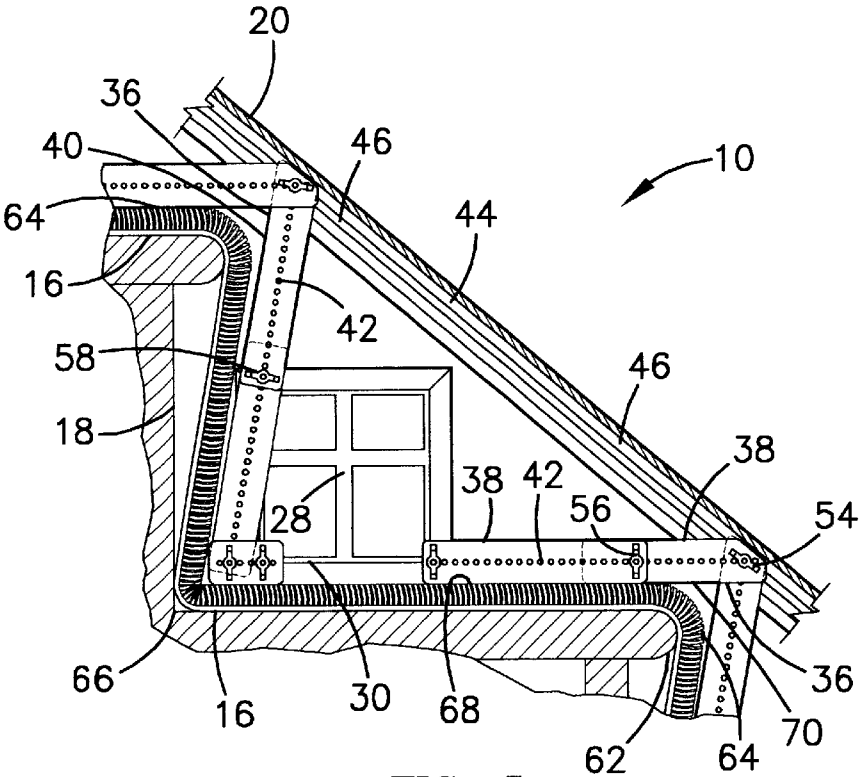
FIG. 5 is a fragmentary side elevation of the light stringer set of FIG. 1 in place on a cross section view of the staircase illustrating the use of framework arms connected to a frame rail to keep the light grille in place showing yet another position for the framework arms and the frame rail typically used on a staircase with a protruding nose on each tread and carpeting secured over the tread and forced into the junction of the riser and the rear edge of the next descending tread.
Figure 4:
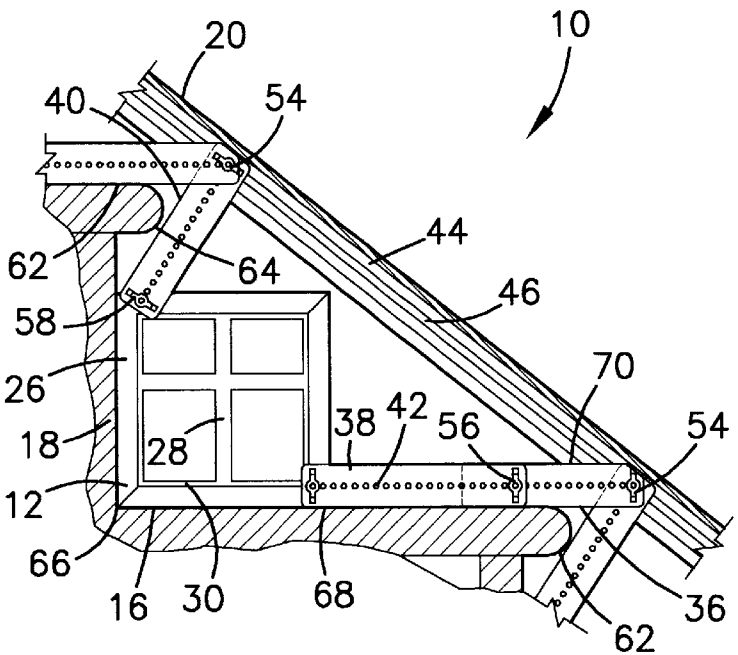
FIG. 4 is a fragmentary side elevation of a portion of the light stringer set of FIG. 1 shown in place on a cross sectional portion of a staircase and illustrating the use of framework arms connected to a frame rail to keep the light grille in place showing different positions of the framework arms and the frame rail for use with a staircase having a protruding nose on each stair tread.
Figure 10:
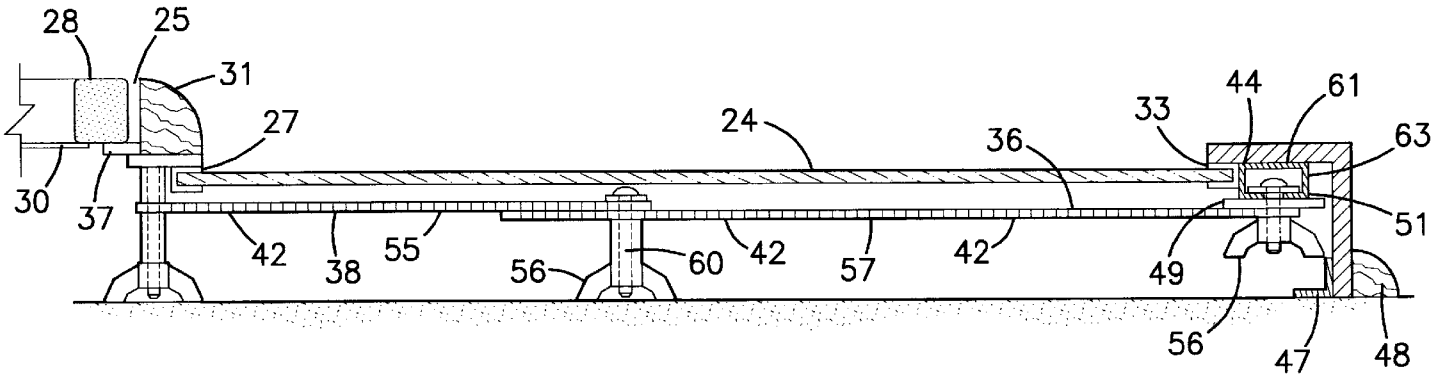
FIG. 10 is a cross sectional end elevation of the frame rail of FIG. 1.

Referring to FIGS. 2 and 10, concealed inside the frame rail 20 and fastened to it is an adjustment base member 44 in the form of a thin flat elongated member having a central adjustment groove 46 with inwardly projecting left-hand flange 49 and inwardly projecting flange 51. The groove 46, or channel, and inwardly projecting flanges 49, 51 retain the head 61 of a screw 60 and washer 63, while allowing it to slide back and forth in the groove 46 (FIGS. 3–5). The adjustment groove 46 is a longitudinal groove running the entire length of the frame rail 20 along an underside 55 of the frame rail 20 so that the adjustment base member 44 and included adjustment groove 46 are concealed from users after installation. The top edge of the frame rail 20 is capped with a quarter-round molding member 48 to provide a clear finished appearance to the light stringer set 10. The frame rail includes a depending lip 50 throughout its length, which covers and conceals the top edge of the in-fill panels 24, again, providing a clean finished appearance.

Still referring to FIG. 2, the lower rear corner of each light grille 12 is butted against the joint between the rear of the stair tread 16 and the next ascending riser 18, and the horizontal arm 38 is extended from the light grille 12, to which it is pivotally attached by a screw or the like, to a point along the adjustable base member 44, to which it is fastened by a wingnut 54, which is then tightened. The horizontal arm 38 consists of two separate horizontal arm members, which are a first horizontal arm member 55 and a second horizontal arm member 57, (See FIG. 10) which overlap at the adjustment wing nut 56, with the amount of overlap determining the overall length of the horizontal arm 38, which is adjusted to fit the distance required with a particular stairway. The extension adjustment wing nut 56 is also tightened, providing a rigid connection between the adjustment base member 44. The upper arm 40 is similarly adjusted and fastened in place with the wingnut 58. Preferably, the upper arm 40 is a single fixed length member that is simply pivoted from the light grille 12 to the frame rail 20 along whatever angle is needed to utilize the full length of the upper arm 40. In each case, the wingnut 54, 56, 58 is connected to and tightens against a bolt 60. Of course, the light stringer set 10 can be adapted to fit a staircase of any length and stair having any particular ratio of run to rise and any particular length of tread or height of riser. Once all the light grilles 12 have been installed and fastened in place, the in-fill panels 24 are cut to size and installed. If the user desires an informal industrial look, the in-fill panels 24 can be omitted. Each wingnut 56 is secured to a corresponding bolt 60 that is butted against the wall 14 to provided some additional strength to the light stringer set 10. As shown most clearly in FIG. 10, a cylindrical sleeve 65 positioned over each bolt 60 between a bolt head 67 and each wingnut 56, whereby each wingnut 56 is seated against the wall when said wingnut is tightened.

Referring to FIG. 3, when the stringer light set 10 is installed on a staircase having a wholly vertical riser 18 and the nose 62 of the stair tread 16 does not project in front of the riser 18, the upper arm 40 is vertically aligned and the horizontal arm 38 is horizontally aligned.

Referring to FIG. 4, when the stringer light set 10 is installed on a staircase having a vertical riser 18 and the nose 62 of the stair tread 16 projects in front of the riser 18, the upper arm 40 is angled away from the nose 62 to the point that it contacts the lower edge 64 of the nose 62 and is more or less perpendicular to the frame rail 20 and the horizontal arm 38 is horizontally aligned.

Referring to FIG. 5, when the stringer light set 10 is installed on a staircase having a vertical riser 18, a nose 62 of the stair tread 16 projecting in front of the riser 18, and the stairs are carpeted with a carpet that is forced into the joint 66 between the rear edge of the stair tread 16 and the lower edge of the adjoining ascending riser 18, the upper arm 40 is angled to the frame rail 20 along the shortest line that allows the upper arm 40 to reach the frame rail 20 and the horizontal arm 38 is horizontally aligned.

In all cases, the upper arm 40 and the horizontal arm 38 are relatively thin elongated members having two overlapping sections, a proximal section 68 and a distal section 70, where proximal means closest to the light grille 12 and distal means farthest from the light grilles 12 to which they are connected.

Figure 6:
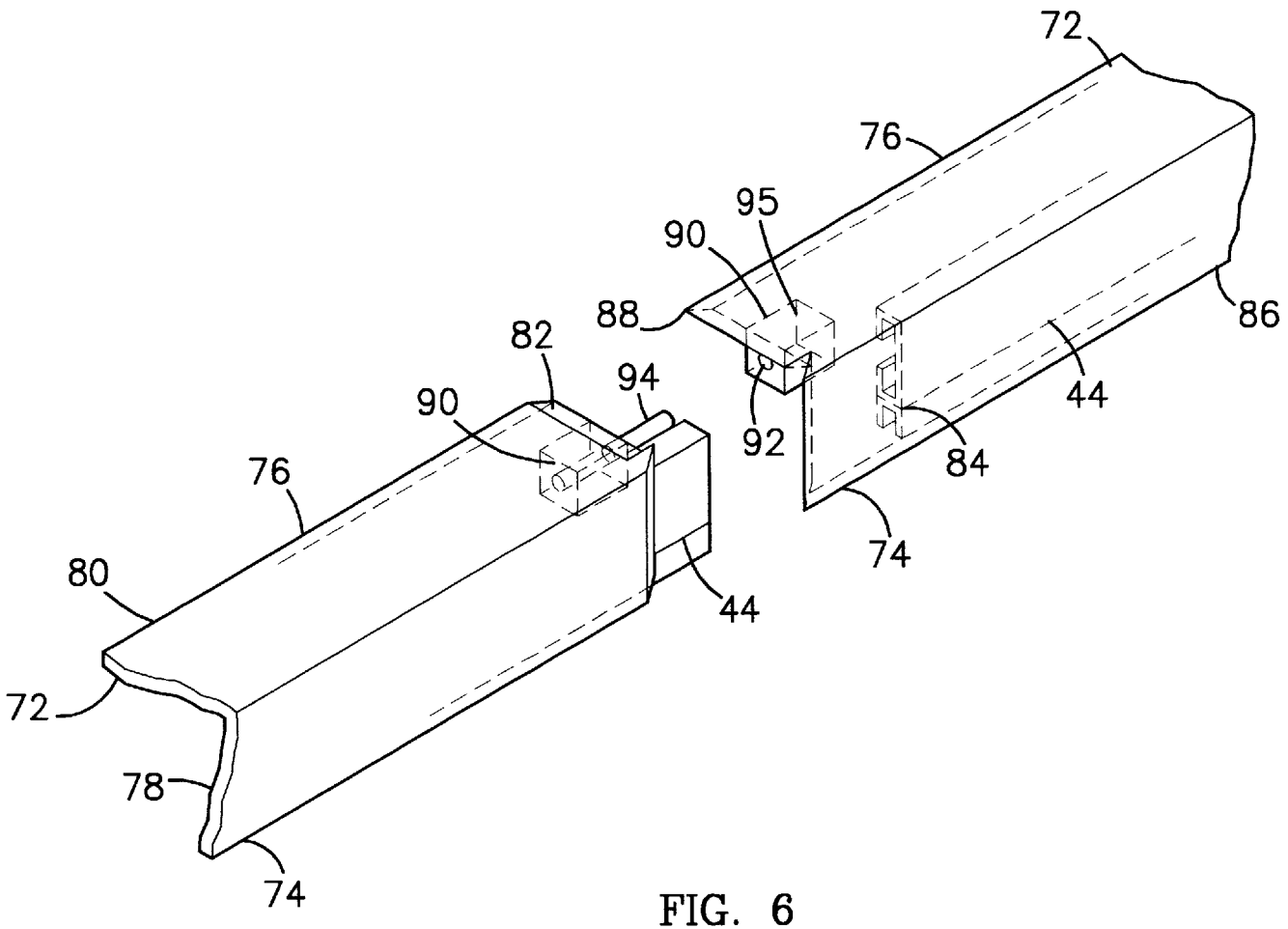
FIG. 6 is a fragmentary perspective view of the frame rail of FIG. 1 showing the connection between sections of the frame rail grille strip.

Referring to FIG. 6, the frame rail 20 includes an angle member 72 having a vertical flange portion 74 and a horizontal flange portion 76 joined at right angles to one another and defining an interior channel 78, which carries and hides the adjustment base member 44, which is routed and built up in the interior channel 78 by glue or other fasteners. The frame rail 20 is formed in sections that can be easily connected together. The frame rail 20 section includes a projecting portion of the adjustment base member 44 that projects beyond the end 82 of the (left-hand) section 80. An end 84 of the adjustment base member 44 (right-hand) section 86 is recessed within the left-hand end 88 by the same distance as the adjustment base member 44 projects from the section 80. A locking block lug 90 includes a bore 92 having a locking pin 94 fixed into it and projecting beyond the end 82 of the section 80 and which is received in the aligned bore 92 in the receiving block 95 which is fixed into the interior channel 78 of the right-hand section 86. Pushing the two sections 80, 86 together firmly locks the two sections together, while allowing them to be disconnected easily. Preferably, the adjustment groove 46 and the upper groove 33 are routed into the vertical flange portion 74 of the angle member 72. Flanges are then adhered and stapled over the routes to define the grooves (See FIG. 10). Alternatively, the entire angle member 72 may be extruded from plastic, epoxy-filled sawdust or the like. This sectional construction allows frame rails 20 of any particular length to be assembled from reasonably sized sections, facilitating handling and shipping.

Figure 9:
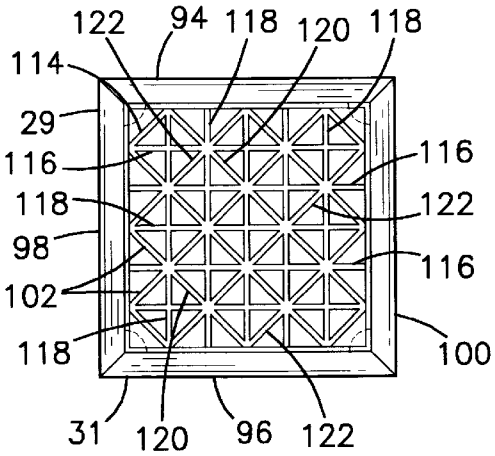
FIG. 9 is a front elevation of a third style of light grille for use with the light stringer set of FIG. 1.
Figure 8:
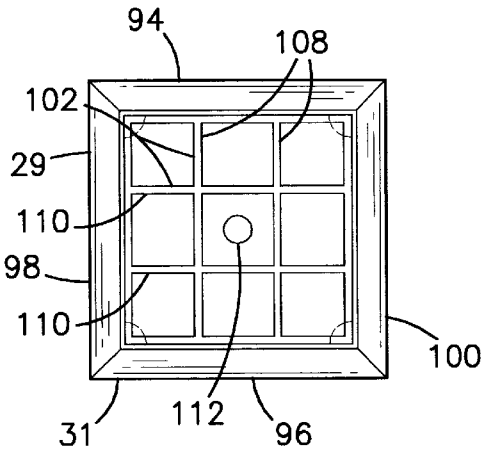
FIG. 8 is a front elevation of a second style of light grille for use with the light stringer set of FIG. 1.
Figure 7:
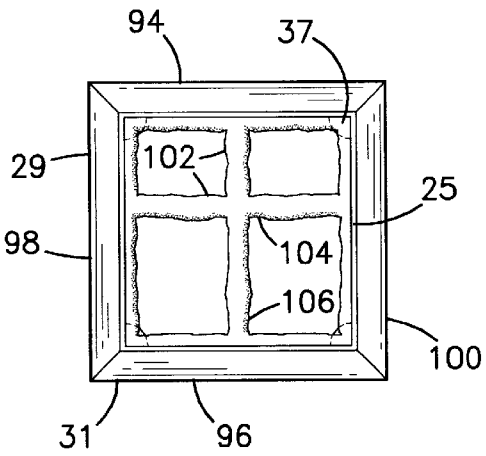
FIG. 7 is a front elevation of one style of light grille for use with the light stringer set of FIG. 1.

Referring now to FIGS. 7, 8, and 9, various designs of the grilles 12 are shown. In FIGS. 7, 8, and 9 the grille 12 includes a frame 29 having a square front elevation including a frame 29 that includes an upper horizontal frame member 94, lower horizontal frame member 96, a left-hand side vertical member 98 and a right-hand side vertical member 100, with the members aligned to form a square and joined at the resulting corners. A quarter round molding 31 fastened to the frame members on the front face of the grille 12 frame 29 provides a finished appearance. Each grille 12 shown has a different pattern of cross bars 102 to form distinctive patterns.

Referring to FIG. 7, the cross bars 102 form a cross having a horizontal bar 104 placed slightly above the middle of the height of the grille 12 and a vertical bar 106 placed in the middle of the width of the grille 12, forming a cross.

Referring to FIG. 8, a pair of spaced vertical bars 108, spaced so as to form three equally sized vertical rectangles and a pair of spaced horizontal bars 110, spaced so as to form three equally sized horizontal rectangles, thereby creating nine squares of equal size. A small circle 112 is embossed or otherwise formed in the center of the translucent panel 30 in the back of the grille 12, or may be an aperture which facilitates ventilation.

Referring to FIG. 9, a lattice work pattern 114 is formed by five equally spaced horizontal bars 116, intersected by five equally spaced vertical bars 118. Four equally spaced diagonal bars 120 run generally from the left-hand side of the grille 12 upwardly and toward the right-hand side of the grille 12 at 45° to the horizontal and intersect the intersections formed by the horizontal bars 116 and the vertical bars 118. Four equally spaced diagonal bars 122 run generally from the left-hand side of the grille 12 downwardly to the right 45° to the horizontal and intersect the intersections formed by the horizontal bars 116 and the vertical bars 118. The combination of these four sets of bars forms the lattice work pattern 114.

Figure 11:
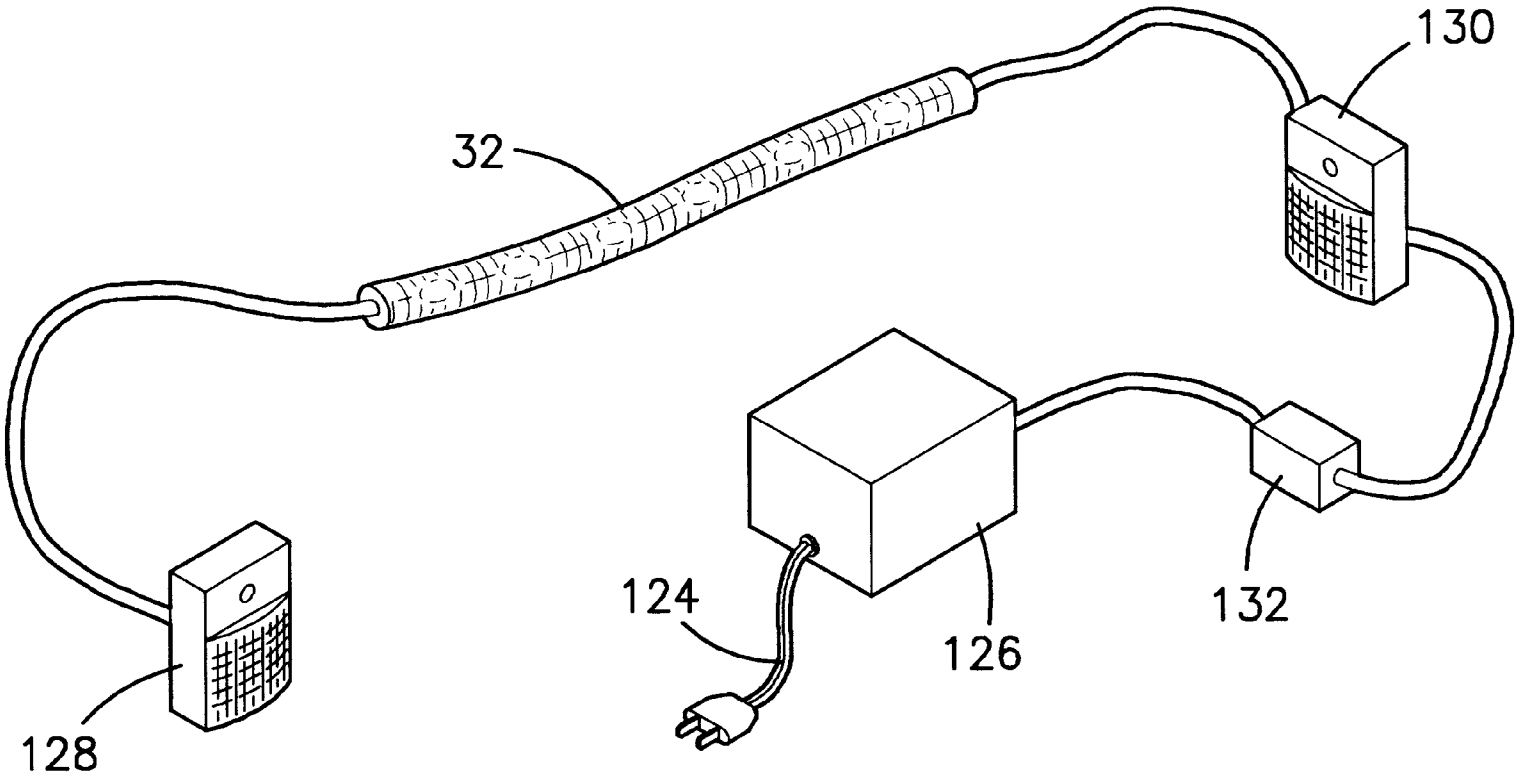
FIG. 11 is a schematic of a circuit for providing light behind the grilles of the light stringer set.

Referring to FIG. 11, in the preferred embodiment utilizes a standard 120 v AC 60Hz electrical power tapped by the plug and associated wire 124 which is reduced and rectified by the reduction transformer/rectifier 126 to provide a low voltage (9–12 v) DC power supply that is turned on by the first motion detector 128 when a person walks past it. The first motion detector 128 is preferably placed at the bottom of the stairs. A second motion detector 130 is placed at the top of the stairs. When a person walks past the second motion detector 130, a signal turns the power off, but the delay timer 132 delays the termination of power to the rope light 32 for a predetermined time that can be set by a user, preferably about five minutes. Similarly, when a person walks past the second motion detector 130 first, which would be the case when a person is descending the stairs, the lights in the rope light 32 are turned on (energized) and then they are turned off when the first motion detector 128 detects the person passing by it, with ultimate termination of the lighting again controlled by the delay timer 132. It has been found that if a motion detector has a field of view of about 120°, a single motion detector can be used. Further, wireless motion detectors can also be used, simplifying the wiring.

Alternatively, the light stringer set can be operated directly by standard household electrical power, although this could present fire and shock hazards, by batteries or any other source of electrical power. The two motion detectors 128, 130 and delay timer 132 can be omitted and replaced by an off and on switch.

Whether the light stringer set 10 is powered by low voltage DC or by household AC electricity, it is usually desirable to plug into the household AC power supply, which can be tapped by inserting an electrical plug into a convenient existing electrical socket or can be made available by means of a power extension connected fished through the wall 14 and connected to a standard socket that will be hidden by the light stringer set 10.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims. The light stringer set 10 may be provided in a kit that homeowners can install themselves with minimal labor, tools and experience.

I claim:

1. A light stringer set for lighting a stairway comprising:

a. at least one light grille seated on a stair tread of the stairway;

b. a frame rail fastened to a wall adjacent to the stairway;

c. means for connecting said at least one light grille to said frame rail; and d. means for providing electrical lighting secured behind said panels.

2. A light stringer set for lighting a stairway in accordance with claim 1 further comprising a plurality of in-fill panels covering the wall space between said frame rail and said light grille.

3. A light stringer set for lighting a stairway in accordance with claim 2 wherein said in-fill panel includes an upper edge seated behind said frame rail.

4. A light stringer set for lighting a stairway in accordance with claim 2 wherein said in-fill panel further includes a lower edge seated behind a frame of said light grille.

5. A light stringer set for lighting a stairway in accordance with claim 1 wherein said light grille further comprises a frame and a grille member adapted to fit into said frame and means for retaining said grille member in said frame.

6. A light stringer set for lighting a stairway in accordance with claim 1 wherein said grilles further comprise a plurality of cross members, thereby forming a pattern.

7. A light stringer set for lighting a stairway in accordance with claim 6 further comprising a translucent panel fixed to a rear side of said light grille.

8. A light stringer set for lighting a stairway in accordance with claim 1 wherein said electrical lighting means further comprises a light rope fastened to said wall adjacent to said light grilles and means for energizing said light rope.

9. A light stringer set for lighting a stairway in accordance with claim 1 wherein said means for connecting said light grille to said frame rail further comprises an upper arm having a proximal end connected to said light grille and a distal end connected to said frame rail and a horizontal arm having a proximal end connected to said light grille and a distal end connected to said frame rail.

10. A light stringer set for lighting a stairway in accordance with claim 9 wherein said horizontal arm further comprises means for adjusting the length of said horizontal arm.

11. A light stringer set for lighting a stairway in accordance with claim 1 wherein said means for connecting said light grille to said frame rail further comprises a longitudinal groove in an underside of said frame rail.

12. A light stringer set for lighting a stairway comprising:

a. at least one light grille seated on a stair tread;

b. a frame rail fastened to a wall adjacent to the stairway, said frame rail being connected to said at least one light grille by an upper arm having a proximal end connected to said light grille and a distal end connected to said frame rail and a horizontal arm having a proximal end connected to said light grille and a distal end connected to said frame rail; and d. means for providing electrical lighting secured behind said panels.

13. A light stringer set for lighting a stairway in accordance with claim 12 wherein said upper arm further comprises a longitudinal member having a plurality of spaced aligned apertures and means for clamping said upper arm to a portion of said frame rail.

14. A light stringer set for lighting a stairway in accordance with claim 13 wherein said horizontal arm further comprises a first horizontal arm member and a second horizontal arm member which overlap one another to provide a length adjustable length horizontal arm.

15. A light stringer set for lighting a stairway in accordance with claim 14 wherein said first horizontal arm member and said second horizontal arm member are fastened together by a bolt passed through an aperture in said first horizontal arm member and an aligned aperture in said second horizontal arm member and a wingnut.

16. A light stringer set for lighting a stairway in accordance with claim 15 further comprising a cylindrical sleeve positioned over said bolt between a bolt head and said wingnut, whereby said wingnut is seated against the wall when said wingnut is tightened.

17. A light stringer set for lighting a stairway comprising:

a. at least one light grille seated on each stair tread of the stairway adjacent to the next higher riser in the stairway;

b. a frame rail fastened to a wall adjacent to the stairway and running the length of the stairway, said frame rail being connected to said at least one light grille by an upper arm having a proximal end connected to said light grille and a distal end connected to said frame rail and a horizontal arm having a proximal end connected to said light grille and a distal end connected to said frame rail; and d. means for providing electrical lighting secured behind said panels.

18. A light stringer set for lighting a stairway in accordance with claim 17 wherein each said light grille further comprises a frame having a translucent panel fixed into said frame.

19. A light stringer set for lighting a stairway in accordance with claim 18 wherein each said light grille further comprises a plurality of grille members in said frame and fixed to said frame, thereby forming a pattern in said frame.

20. A light stringer set for lighting a stairway in accordance with claim 17 wherein said means for providing electrical lighting secured behind said panels further comprises a light rope electrically connected to at least one motion sensor and a source of electrical power.

* * * * *